US009084514B1

(12) United States Patent
Elswick

(10) Patent No.: US 9,084,514 B1
(45) Date of Patent: Jul. 21, 2015

(54) FOOT SCRUBBING APPARATUS

(76) Inventor: Eric L. Elswick, Galion, OH (US)

( * ) Notice: Subject to any disclaimer, the term of this patent is extended or adjusted under 35 U.S.C. 154(b) by 41 days.

(21) Appl. No.: 13/489,767

(22) Filed: Jun. 6, 2012

(51) Int. Cl.
*A47K 7/02* (2006.01)
*A47K 7/03* (2006.01)
*A47K 3/022* (2006.01)

(52) U.S. Cl.
CPC . *A47K 7/03* (2013.01); *A47K 3/022* (2013.01); *A47K 7/026* (2013.01)

(58) Field of Classification Search
CPC ..... A47K 3/022; A47K 7/03; A47K 7/026
USPC ..... 15/104.92, 160, 161; 4/606; 601/136; 222/372, 491, 494, 495
See application file for complete search history.

(56) References Cited

U.S. PATENT DOCUMENTS 3,548,439 A * 12/1970 Berst ..... 15/104.92
4,360,130 A * 11/1982 Nishimura et al. ..... 222/153.09
4,532,668 A * 8/1985 Slonicki ..... 15/104.92
5,163,200 A 11/1992 Carlin et al.
5,435,465 A * 7/1995 El-Amin ..... 222/108
5,520,618 A * 5/1996 Massiet ..... 601/136
6,223,379 B1 * 5/2001 Martin ..... 15/104.92
6,367,662 B1 * 4/2002 Dorman et al. ..... 222/181.3
6,405,400 B1 6/2002 McClain
6,540,105 B2 * 4/2003 Dorman et al. ..... 222/1
6,584,636 B2 * 7/2003 Schlem ..... 15/104.92
6,618,870 B2 * 9/2003 Farias ..... 4/605
6,662,398 B1 * 12/2003 Thomson ..... 15/104.92
6,733,595 B1 5/2004 Grillo
7,066,356 B2 * 6/2006 Schuman et al. ..... 222/153.01
7,120,947 B1 * 10/2006 Magallanes ..... 4/606
7,527,178 B2 * 5/2009 Lewis ..... 222/333
7,568,598 B2 * 8/2009 Ophardt et al. ..... 222/518
7,806,301 B1 * 10/2010 Ciavarella et al. ..... 222/207
8,127,969 B2 * 3/2012 Brown et al. ..... 222/192
2007/0022527 A1 * 2/2007 Russo et al. ..... 4/606
2008/0201879 A1 * 8/2008 Heidemeyer ..... 15/88.2
2009/0113616 A1 * 5/2009 Daly, Sr. ..... 4/606
2010/0043137 A1 * 2/2010 Zavan ..... 4/622
2010/0088816 A1 * 4/2010 Rollins ..... 4/568
2010/0175213 A1 * 7/2010 Fitzwater ..... 15/160

* cited by examiner

*Primary Examiner* — Monica Carter
*Assistant Examiner* — Michael Jennings
(74) *Attorney, Agent, or Firm* — Robert C. Montgomery; Montgomery Patent and Design, L.P.

(57) ABSTRACT

A foot scrubbing apparatus for scrubbing and cleaning one's feet while in a shower or bathtub and which is attached to the shower wall. The apparatus includes a soap reservoir having a manual pump mechanism that forces liquid soap through a tube to a foot component. The foot component attaches to the floor and includes multiple bristles for cleaning the bottom of the foot. The top of the foot is cleaned using a "U"-shaped saddle that also has bristles for cleaning. Soap is directed into the saddle area where it is discharged onto the foot via orifices.

18 Claims, 3 Drawing Sheets

FOOT SCRUBBING APPARATUS

RELATED APPLICATIONS

There are currently no applications co-pending with the present application.

FIELD OF THE INVENTION

The presently disclosed subject matter is directed to personal cleaning devices. More particularly, the present invention relates to a foot scrubbing apparatus designed to be used in a shower.

BACKGROUND OF THE INVENTION

The age-old problem associated with the washing of one's feet while standing in a shower or tub has never really been solved. Usually, a person is forced to stand on one (1) foot while washing the other. This feat is difficult for even those in good physical condition. People who are elderly, disabled, overweight, or just clumsy, find it next to impossible to do. Long-handled scrub brushes have also been used, but they are often hard to use and ineffective due to the fact it is difficult to apply enough pressure over a long handle to clean one's feet. Because of the forgoing difficulty people often do nothing about cleaning their feet, thus sacrificing personal hygiene and the overall health and well being of having clean feet.

Accordingly, there is a need for a way by which an individual can quickly and easily cleanse and scrub their feet while in a shower or bathtub without the disadvantages normally associated with conventional feet cleaning methods.

SUMMARY OF THE INVENTION

The principles of the present invention provide for a foot washing apparatus that enables an individual to quickly and easily cleanse and scrub their feet while in a shower or bathtub.

A foot washing apparatus in accord with the present invention includes a soap dispenser with a manual pump assembly that is operated by an outward facing pump handle. When the pump handle is pressed liquid soap is pressurized for dispensing. A pressure valve prevents unpressurized liquid soap from leaking from the soap dispenser. The foot washing apparatus also includes a foot cleaning unit having a base with a first set of apertures and a first set of bristles, a first side extension that extends up from one (1) side of base, a second side extension that extends up from a second side of the base. The first side extension and the side second extension have a second set of apertures and a second set of bristles. The foot cleaning unit also includes a cleaning saddle that is between the first side extension and the second side extension. The cleaning saddle includes a third set of apertures and a third set of bristles. A flexible hose connects the soap dispenser to the foot cleaning unit. Inward force on the pump handle pressurizes liquid soap through the flexible hose and out of the apertures.

The foot washing apparatus beneficially further includes a plurality of suction cups for retaining the foot washing apparatus in position in a shower. The soap dispenser beneficially includes a mounting frame that holds a soap bottle and the manual pump assembly in position. In practice the soap bottle will have a threaded cap to enable refilling the soap bottle with liquid soap, and the soap bottle is mounted to the mounting frame by a spring clip.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
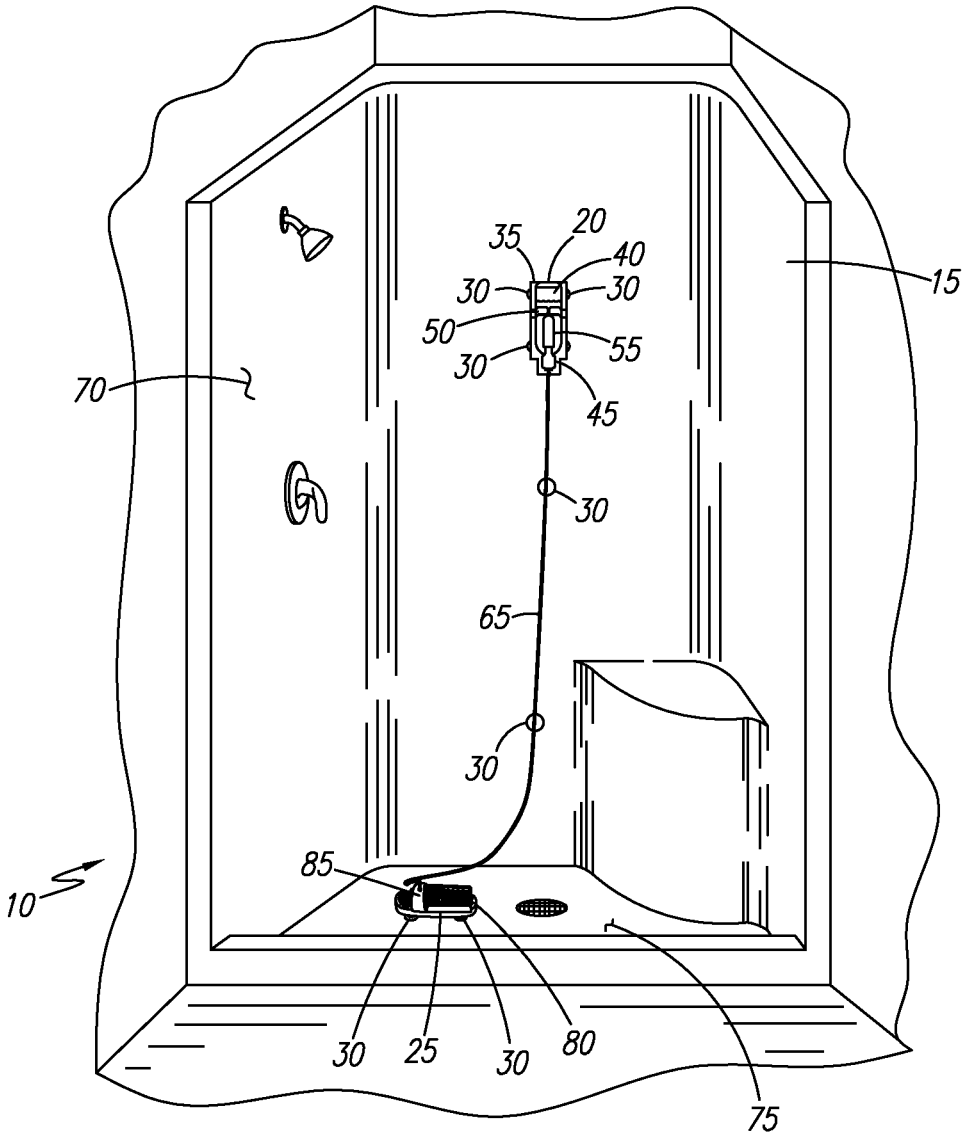
FIG. 1 is an isometric view of a foot washing apparatus 10 according to the preferred embodiment of the present invention and shown in a shower 15.

10 foot washing apparatus
15 shower
20 soap dispenser
25 foot cleaning unit
30 suction cups
35 mounting frame
40 soap bottle
42 cap
45 manual pump assembly
50 spring clip
55 pump handle
60 liquid soap
65 flexible hose
70 shower wall
75 floor
80 base section
85 cleaning saddle
90 pressure valve assembly
95 side extension
100 first set of bristles
105 second set of bristles
110 barbed connection port
115 hollow cavity
120 third set of bristles
123 aperture
125 discharge orifices

DETAILED DESCRIPTION OF THE PREFERRED EMBODIMENT

The best mode for carrying out the invention is presented in terms of its preferred embodiment, herein depicted within FIGS. 1 through 5, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The preferred embodiment of the present invention is depicted within FIGS. 1 through 5. In particular FIG. 1 shows an isometric view of a foot washing apparatus 10 being used in a shower 15. The foot washing apparatus 10 includes a soap dispenser 20 and a foot cleaning unit 25. The soap dispenser 20 is mounted on a wall 70 where it is held in place via suction cups 30. The soap dispenser 20 uses a mounting frame 35 which holds a removable squeezable soap bottle 40 that is threaded into a manual pump assembly 45. A spring clip 50 holds the soap bottle 40 in an inverted vertical position. Finally, a pump handle 55 is provided to operate the manual pump assembly 45 and force liquid soap 60 (see FIG. 2) through a flexible hose 65. Further detail on the soap dispenser 20 will be provided herein below.

Still referring to FIG. 1, a series of additional suction cups 30 hold the flexible hose 65 to the shower wall 70 such that it does not interfere with use thereof or other bathing activities. The flexible hose 65 terminates at the foot cleaning unit 25 which rests upon the floor 75 of the shower 15, preferably in a location that is easy to reach with a user's foot while he or she is in the shower 15. The foot cleaning unit 25 includes a base section 80 and a cleaning saddle 85 (described in more detail subsequently). The foot cleaning unit 25 is also held in place with suction cups 30 as shown. The suction cups 30 used with the soap dispenser 20, the foot cleaning unit 25 and the flexible hose 65 allow for easy movement on any smooth surface. The suction cups 30 also enable the various components to be easily removed for cleaning and maintenance.

Figure 2:
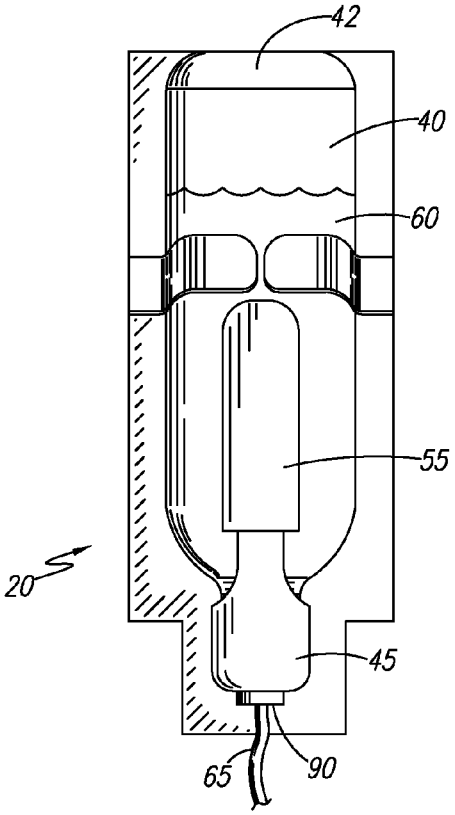
FIG. 2 is a front view of a soap dispenser 20 used in the foot washing apparatus 10 shown in FIG. 1.

Refer next to FIG. 2, which is a front view of the soap dispenser 20 used with the foot washing apparatus 10. The various components of the soap dispenser 20 are preferably made of plastic using an injection molding process. The soap bottle 40 can be provided as part of the foot washing apparatus 10 or it could be provided as a separate replaceable/refillable unit. A user could refill the soap bottle 40 with a liquid soap 60 of his or her choosing. The soap bottle 40 has a threaded cap 42 at its upper end. This enables easy removal and replenishment of the liquid soap 60.

The soap dispenser 20 includes a pump handle 55 which beneficially has an ergonomic non-slip design that can be operated by simply pressing against it with one's hand. This enables use with wet or soap-covered hands. In practice other parts of a user's body can also be used should use by a hand not be possible. This feature can be important when one considers the difficulty in washing one's feet without hands. The internal components of the manual pump assembly 45 are well known in the art and would be similar to the manual pump mechanisms used in conventional liquid soap containers, hand cream dispensers, hand sanitizer dispensers and the like. A pressure valve assembly 90 is provided at the base of the manual pump assembly 45 to prevent inadvertent leakage of the liquid soap 60 through the flexible hose 65 (as shown in FIG. 1) when the foot washing apparatus for shower use 10 is not in use.

Figure 3:
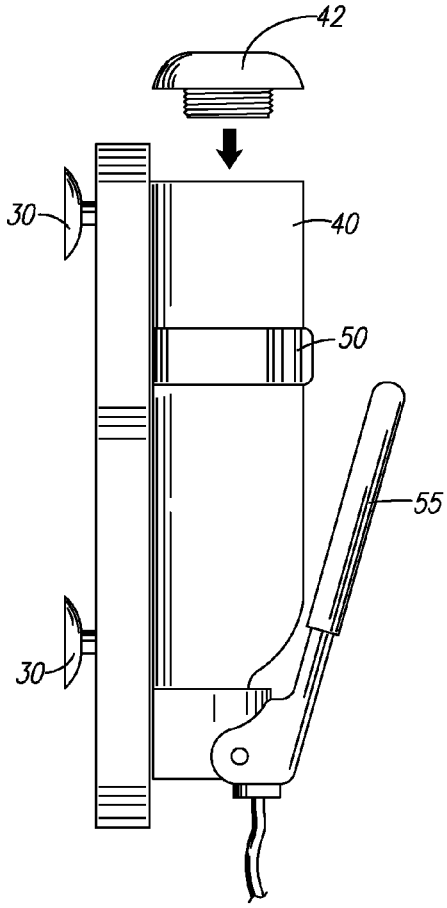
FIG. 3 is a side view of the soap dispenser 20 shown in FIG. 2.

Refer now to FIG. 3, a side view of the soap dispenser 20 as used with the foot washing apparatus 10. This figure more clearly shows the operation of the spring clip 50 and how it aids in the retention of the soap bottle 40. While depicted as a mechanical strap, the functionality of the spring clip 50 could also be accomplished by a nylon strap, a hook and loop fastener, a rubber strap or the like. As such, the depiction of a specific type of spring clip 50 is not intended to be a limiting factor of the present invention. FIG. 3 also depicts the outward facing orientation of the pump handle 55 and highlights the ease upon which it can be used.

Figure 4:
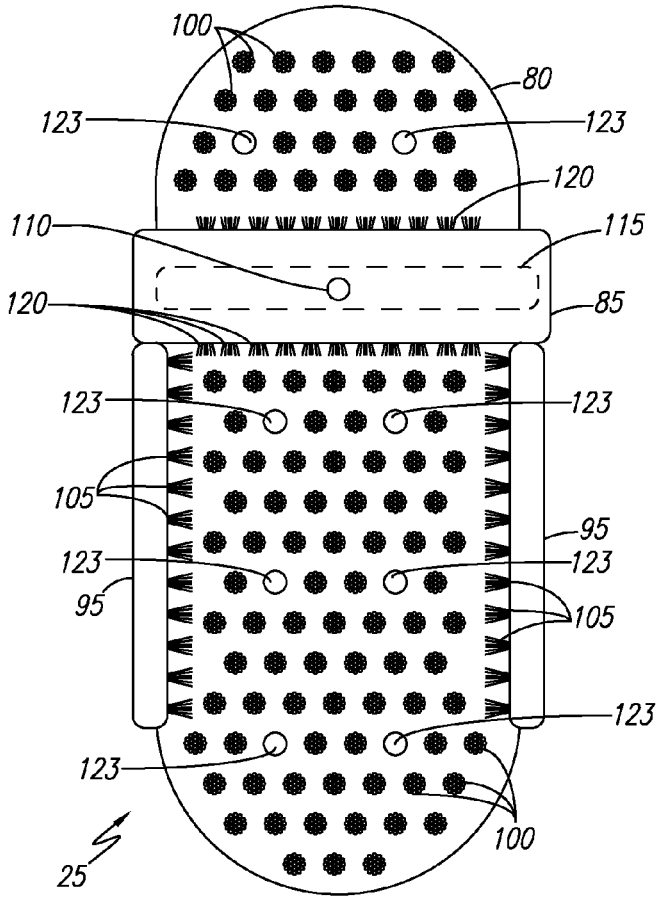
FIG. 4 is a top view of a foot cleaning unit 25 as used with the foot washing apparatus 10 shown in FIG. 1; and, FIG. 5 is an end view of the foot cleaning unit 25 shown in FIG. 4.

Referring next to FIG. 4, a top view of the foot cleaning unit 25, the base section 80 has two (2) side extensions 95 that perpendicularly extend upward from the base section 80. Additionally, the base section 80 has a plurality of equally-spaced apertures 123 that allow drainage of water during and after use. The upper surface of the base section 80 is provided with a first set of bristles 100 that are used for cleaning and scrubbing the bottom of one's foot. The side extensions 95 are provided with a second set of bristles 105 for cleaning the sides of one's foot. They second set of bristles 105 are of a length sufficient to allow different foot widths to pass through them while maintain contact for thorough cleaning.

Still referring to FIG. 4, the overall configuration and orientation of the side extension 95 as well the base section 80 allow use with either the right or left foot of a user. The cleaning saddle 85 is beneficially hollow and provides a barbed connection port 110 for connection of the flexible hose 65 (shown in FIG. 1). A hollow cavity 115 (depicted by hidden lines) is used for the distribution of the liquid soap 60. A third set of bristles 120 (partially visible in this figure) are located on the underside of the cleaning saddle 85. The first set of bristles 100, the second set of bristles 105, and the third set of bristles 120 are envisioned as being soft pliable bristles that easily bend under moderate foot pressure but spring back erect for thorough cleaning.

Figure 5:
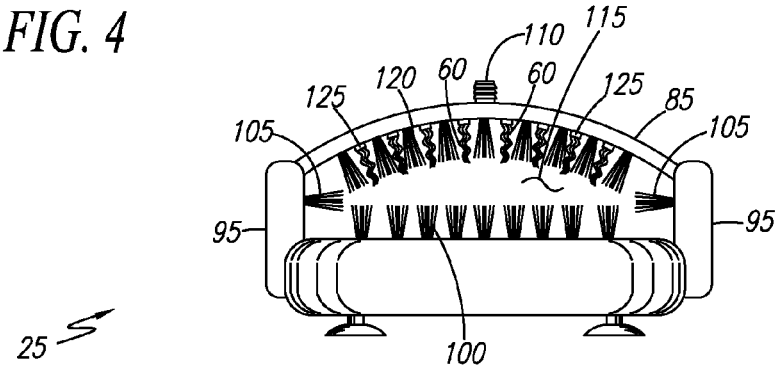

Refer finally to FIG. 5, an end view of the foot cleaning unit 25. This figure clearly shows how the third set of bristles 120 are located on the underside of the cleaning saddle 85 to clean the top of the foot as the foot is slid in and out of the cleaning saddle 85. FIG. 5 also clearly depicts the functionality of the second set of bristles 105 as positioned upon the side extension 95.

Three hundred sixty degrees)(360° cleaning coverage of one's foot is possible when used in conjunction with the first set of bristles 100 Liquid soap 60 from the hollow cavity 115 is distributed via a series of discharge orifices 125 that are located on the underside of the cleaning saddle 85 between the bristles of the third set of bristles 120. As a user works their foot in and out of the foot cleaning unit 25 liquid soap 60 is released onto the user's foot and distributed among the various bristles of the first set of bristles 100, the second set of bristles 105, and the third set of bristles 120. This action provides for thorough cleaning of all foot surfaces without the necessity of bending over. The coverage afforded by the length of the bristles used in the first set of bristles 100, the second set of bristles 105 and the third set of bristles 120 allows the foot washing apparatus 10 to be used with feet of a wide range of sized from small children up to full size adults.

Preferably the structural components of the foot washing apparatus 10 are made of heavy duty impact resistant plastic in an injection molding process. Such a material is corrosion resistant and is easily cleaned after use by simple rinsing.

It is envisioned that other styles and configurations of the present invention can be easily incorporated into the teachings of the present invention; while only one particular configuration is shown and described that is for purposes of clarity and disclosure and not by way of limitation of scope.

The preferred embodiment of the present invention can be used by a common user in a simple and effortless manner with little or no training. It is envisioned that the foot washing apparatus 10 would be constructed in general accordance with FIG. 1 through FIG. 5. Upon purchase by a user, the soap dispenser 20 and the foot cleaning unit 25 are placed in a shower 15 as shown in FIG. 1. The location of the soap dispenser 20 may be set for use by the average height of the average user and by the availability of a smooth wall. The foot cleaning unit 25 would be positioned off to the side of the floor 75 where it is accessible by the user in a standing position in the shower 15, but preferably not in direct path of water flow, drains, and the like. The soap dispenser 20 and the foot cleaning unit 25 would then be interconnected by the flexible hose 65 applied in a leak-proof manner. The soap dispenser 20, the foot cleaning unit 25, and the flexible hose 65 would be secured in place by the use of the suction cups 30.

Next, the user would remove the cap 42 to fill the soap bottle 40 with the desired liquid soap 60. At this time, the foot washing apparatus 10 is ready for use.

During actual use of the foot washing apparatus 10, the user would place his foot into the foot cleaning unit 25 and under the cleaning saddle 85. Next, the user would activate the manual pump assembly 45 using the pump handle 55 such that liquid soap 60 is forced through the flexible hose 65 and out of the discharge orifices 125 on the underside of the cleaning saddle 85. The user would then work his foot back and forth, forming lather while the bristles of the first set of bristles 100, the second set of bristles 105 and the third set of bristles 120 clean the bottom, sides and top of his foot respectively.

It should be noted that the foot washing apparatus 10 is intended to clean one foot at a time with the user standing securely on the other foot while possibly holding a stationary object with their hands for stability. After cleaning one foot that foot might be thoroughly rinsed and placed on the floor 75 to prevent slipping. The user can then clean the other foot. When finished with use, water is run over the foot cleaning unit 25 to rinse it. The foot washing apparatus 10 may be removed from the shower 15 or left in place for future bathing/cleaning events.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A foot washing apparatus, comprising:

a soap dispenser having a manual pump assembly with an outward facing pump handle for pressuring liquid soap for dispensing, said manual pump assembly having a pressure valve that prevents liquid soap from draining from said soap dispenser when said pump handle is not pressuring liquid soap;

a foot cleaning unit having at least one aperture and a first set of bristles; and, a flexible hose connecting said manual pump assembly to said foot cleaning unit;

wherein said soap dispenser is configured to be mounted on a wall;

wherein said foot cleaning unit is configured to be mounted on a floor;

wherein inward pressure on said pump handle forces liquid soap through said flexible hose to said foot cleaning unit and out of said at least one aperture; and, wherein said foot cleaning unit includes a base having a first set of apertures and a first set of bristles, a first extension that extends from a first side of said base, a second extension that extends from a second side of said base, wherein said first extension and said second extension have a second set of apertures and a second set of bristles, and a cleaning saddle between said first extension and said second extension, wherein said cleaning saddle includes a third set of apertures and a third set of bristles.

2. The foot washing apparatus according to claim 1, wherein said soap dispenser includes a mounting frame retaining said manual pump assembly in position.

3. The foot washing apparatus according to claim 2, wherein said soap dispenser further includes a removable soap bottle operatively coupled to said manual pump assembly for retaining liquid soap and for supply said liquid soap to said manual pump.

4. The foot washing apparatus according to claim 3, wherein said soap bottle includes a threaded cap to seal said soap bottle.

5. The foot washing apparatus according to claim 4, wherein said soap bottle is mounted to said mounting frame by a spring clip.

6. The foot washing apparatus according to claim 5, further including suction cups attached to said mounting frame for attaching to a wall.

7. The foot washing apparatus according to claim 1, wherein said foot cleaning unit further includes a connection port for connecting to said flexible hose.

8. The foot washing apparatus according to claim 7, wherein said connection port is a barbed connector.

9. The foot washing apparatus according to claim 7, wherein pressurized liquid soap applied to connection port is forced out of said first set of apertures, said second set of apertures, and said third set of apertures.

10. The foot washing apparatus according to claim 9, further including a plurality of suction cups attached to said base for retaining said foot cleaning unit to a floor.

11. The foot washing apparatus according to claim 9, wherein said first set of bristles, said second set of bristles, and said third set of bristles are soft pliable bristles that easily bend.

12. The foot washing apparatus according to claim 1, further including a suction cup attached to said flexible hose for retaining said flexible hose in position on a wall.

13. A foot washing apparatus, comprising:

a soap dispenser having a manual pump assembly with an outward facing pump handle for pressuring liquid soap for dispensing and a pressure valve for preventing unpressurized liquid soap from leaking from said soap dispenser;

a foot cleaning unit having a base having a first set of apertures and a first set of bristles, a first side extension that extends up a first side of said base, a second side extension that extends from a second side of said base, wherein said first side extension and said side second extension have a second set of apertures and a second set of bristles, and a cleaning saddle disposed between said first side extension and said second side extension, wherein said cleaning saddle includes a third set of apertures and a third set of bristles; and, a flexible hose connecting said soap dispenser to said foot cleaning unit;

wherein said soap dispenser is configured to be mounted on a wall;

wherein said foot cleaning unit is configured to be mounted on a floor; and, wherein inward force on said pump handle pressurizes liquid soap through said flexible hose and out of said first set of apertures, said second set of apertures, and said third set of apertures.

14. A foot washing apparatus according to claim 13, further including a plurality of suction cups for retaining said foot washing apparatus in position in a shower.

15. A foot washing apparatus according to claim 13, wherein said soap dispenser further includes a mounting frame and a soap bottle, wherein said mounting frame retains said soap dispense and said manual pump assembly in position.

16. The foot washing apparatus according to claim 15, wherein said soap bottle includes a threaded cap.

17. The foot washing apparatus according to claim 16, wherein said soap bottle is mounted to said mounting frame by a spring clip.

18. The foot washing apparatus according to claim 13, wherein said foot cleaning unit further includes a connection port for connecting to said flexible hose.

* * * * *